United States Patent [19]

Waller, Jr.

[11] Patent Number: 4,600,336

[45] Date of Patent: Jul. 15, 1986

[54] INTERLOCKING WOODEN MAT

[76] Inventor: A. J. Waller, Jr., 2635 Grand Blvd., Port Neches, Tex. 77651

[21] Appl. No.: 588,043

[22] Filed: Mar. 9, 1984

[51] Int. Cl.[4] ..... E01C 5/14; E01C 9/08

[52] U.S. Cl. ..... 404/35; 404/40; 404/41; 404/46; 52/581; 52/593

[58] Field of Search ..... 404/35, 36, 40, 41, 404/46; 52/125.2, 177, 314, 342, 581, 592, 593

[56] References Cited

U.S. PATENT DOCUMENTS

| | | | |
|---|---|---|---|
| 152,299 | 6/1874 | McCauley | 404/46 X |
| 2,652,753 | 9/1953 | Smith | 52/581 X |
| 2,819,026 | 1/1958 | Leyendecker | 404/41 X |
| 2,912,909 | 11/1959 | Hart | 404/36 |
| 3,703,059 | 11/1972 | Kessler | 52/581 X |
| 3,964,221 | 6/1976 | Berquist | 52/592 X |
| 3,990,197 | 11/1976 | Johnston | 52/125.2 |
| 4,016,692 | 4/1977 | Jordan et al. | 52/314 |
| 4,289,420 | 9/1981 | Davis et al. | 404/35 |
| 4,462,712 | 7/1984 | Penland, Sr. | 404/46 X |

*Primary Examiner*—James A. Leppink
*Assistant Examiner*—John F. Letchford
*Attorney, Agent, or Firm*—Neal J. Mosely

[57] ABSTRACT

An interlocking wooden mat assembly for supporting heavy equipment and vehicles around oil field drilling sites and the like comprises a three layered lamination of substantially parallel and closely spaced wooden planks forming each layer. Selected planks of the top layer are offset longitudinally and extend beyond the intermediate layer at one end to provide a male extension on one end and a female recess at the other end. Selected planks of the intermediate layer are offset laterally to extend beyond the surface and underlying layers at one side to provide a male extension on that side and a female recess at the other side. The surface layer has one less plank than the underlying layer to provide an exposed area on the side of the intermediate layer and to expose recessed areas on one side plank of the underlying layer. The mats may be removably secured together in end-to-end and edge-to-edge relation by the male extensions fitting the female recesses and being nailed together at the point of overlap. A removable tie-in plank is secured over the exposed nailed joints of adjacent mats to interlock such mat assemblies together. Each mat assembly may have loops of cable for lifting and transporting.

24 Claims, 10 Drawing Figures

INTERLOCKING WOODEN MAT

BACKGROUND OF THE INVENTION

Field of the Invention

This invention relates to temporary roadways, and more particularly to reusable wooden mat units which can be easily transported and interlocked with other like units edge to edge, edge to end, or end to end to form a strong wooden surface suitable for use around oil field drilling sites and for supporting heavy equipment and vehicles.

BRIEF DESCRIPTION OF THE PRIOR ART

Wooden mats are known in the art for use in highway and construction sites. There are several patents which disclose various wooden mat constructions.

Brown, U.S. Pat. No. 70,515 discloses a wood pavement construction formed of embeded foundation timers in an arch shape from curb to curb which support a plurality of interlocking wooden blocks.

McCauley, U.S. Pat. No. 152,299 discloses a wood pavement formed of a series of spaced apart lateral and longitudinal stringers with sand fill packed between and which support a plurality of wooden pavement blocks.

Smith, U.S. Pat. No. 2,652,753 discloses an intermeshing matting comprising parallel upper and lower runners connected to a series of parallel transverse members disposed therebetween. The ends of each adjacent pair of upper runners are staggered to terminate intermediate the width of the end transverse member or terminate beyond the end transverse member. The ends of each adjacent pair of lower runners is staggered opposite to the runners above them. Modifications include a pattern of staggering every other runner, or a single runner and an adjacent pair. There is no provision for interlocking the units in a side by side arrangement, and the disclosure suggests that in most case it is not necessary to positively connect the sections together, as the friction of interfitting is allegedly sufficient for this purpose.

Leyendecker U.S. Pat. No. 2,819,026 discloses two-ply wooden mats which interlock only in end-to-end relation.

Davis, et al, U.S. Pat. No. 4,289,420 discloses a wooden mat comprising a surface layer of longitudinal top wooden planks, an intermediate layer of transverse planks more widely spaced, and an underlying layer of longitudinal bottom planks. A short stabilizing plank is mounted transversely at the end of the longitudinal bottom planks. The ends of the top layer are alternately staggered in a manner to provide alternate longitudinally staggered lap joints for interconnecting the ends of a like mat. The ends of the intermediate transverse planks extend outward the same distance on one side, such that the rotating one mat through 180 degrees and interlocking the extended ends, the sections may be interlocked side by side. To disassemble such an interlocking system once connected, it becomes necessary to dismantle almost one entire section to remove one section from another.

The prior art in general, and none of these patents in particular, disclose a reusable interlocking wooden mat assembly having lifting and transporting means and novel interlocking construction whereby offset planks and exposed areas are positioned relative one to another such that the extended ends of the planks of one mat may be received and removably secured within the exposed areas of a similar adjacent mat in an edge to edge, end to edge, or end to end configuration.

SUMMARY OF THE INVENTION

It is often necessary during the exploration, establishment, and servicing of oil field drilling sites to transport heavy equipment and vehicles into remote isolated areas over very primitive terrain and ground conditions.

Typical areas would have no roads and may be swamp land, mud fields, or sand fields. It is very costly if vehicles become bogged down, are unable to reach the site, or inadequate terrain exists for storage of heavy equipment.

It is therefore an object of the present invention to provide an interlocking wooden mat section for constructing a strong wooden surface suitable for use around oil field drilling sites for supporting heavy equipment and vehicles.

It is another object of this invention to provide a wooden mat section for construction of temporary roadways and storage areas in remote locations, such as oil fields and the like.

Another object of this invention is to provide a wooden mat section having a convenient lifting means for lifting and transporting and handling the sections with conventional equipment.

Another object of this invention is to provide reusable wooden mat sections which are easily transported and interlocked with other like sections and may be quickly removed and transported to another location.

Another object of this invention is to provide a wooden mat section which may be interlocked with other like sections longitudinally or laterally in an edge to edge, edge to end, or end to end configuration.

Another object of this invention is to provide a wooden mat section which is reusable.

Other objects of the invention will become apparent from time to time throughout the specification and claims are hereinafter related.

The above noted objects and other objects of the invention are accomplished by a reusable wooden mat assembly which can be easily transported and interlocked with other like sections edge to edge, edge to end, or end to end to form a strong wooden surface suitable for use around oil field drilling sites and for supporting heavy equipment and vehicles.

DESCRIPTION OF THE PREFERRED EMBODIMENT

Figures 1, 2:
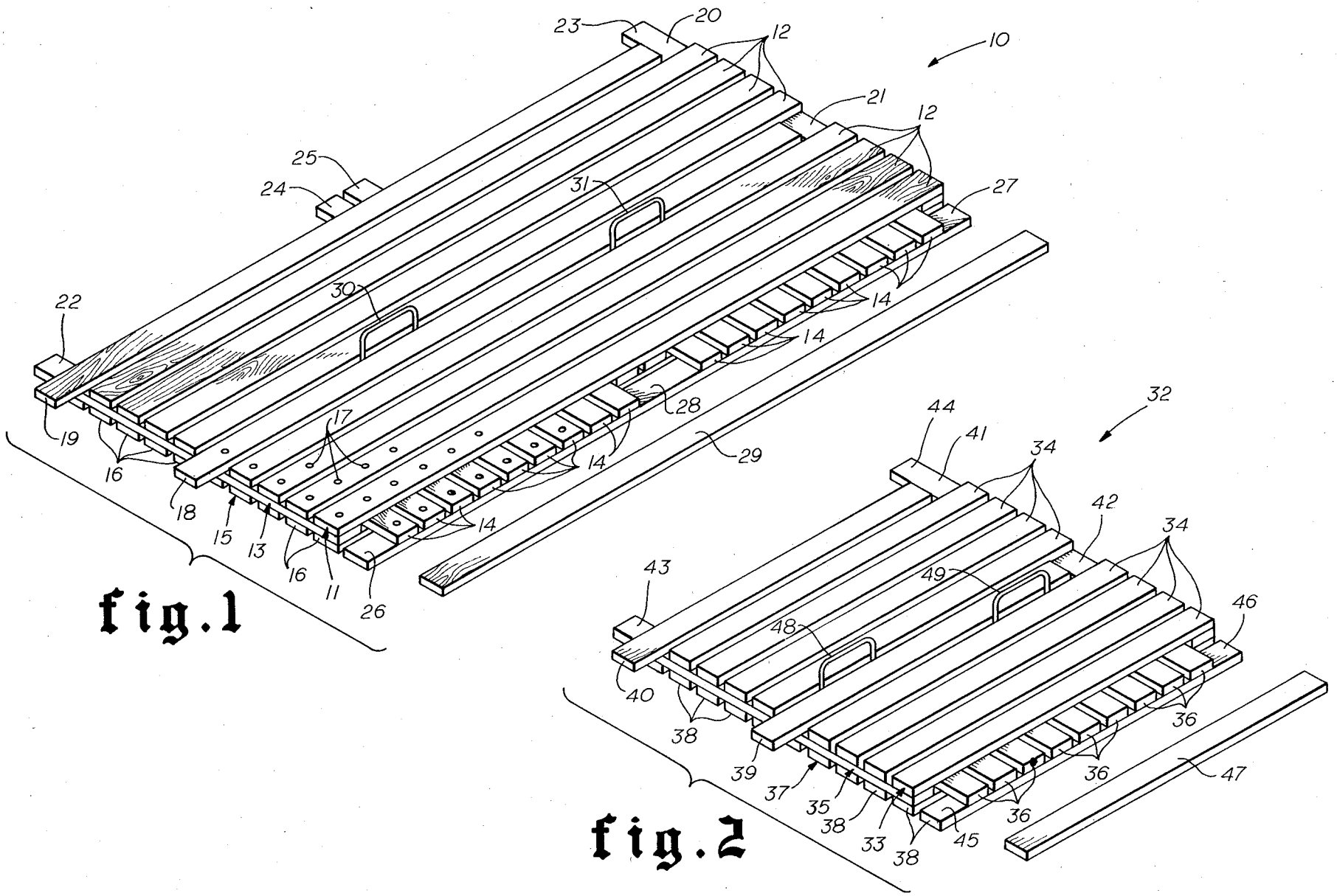
FIG. 1 is an isometric view of one embodiment of the interlocking wooden mat.
FIG. 2 is an an isometric view of an alternate embodiment of the interlocking wooden mat.

Referring to the drawings by numerals of reference, and more particularly to FIG. 1, there is shown a single assembled interlocking mat section 10. Mat section 10 is three-ply laminate of a top layer 11, comprising substantially parallel and closely spaced longitudinal top wooden planks 12; intermediate layer 13, comprising substantially parallel and closely spaced transverse planks 14, and bottom layer 15, comprising substantially parallel and closely spaced longitudinal planks 16. The planks of respective layers 11, 13, and 15 are composed of suitable material such as road grade lumber and are joined together by nails 17.

The length of the mat 10 of FIG. 1 is approximately twice the width so that the mats 10 can be interconnected with like sections edge to edge, end to edge, or end to end. One commercially designed mat is 7'11"×15'11". Two of the top planks 12 are offset longitudinally to extend beyond the intermediate layer 13 the distance of the width of one transverse plank 14 at one end and to leave exposed areas, or female recesses 20 and 21 of the same dimension at the other end. The extended male ends 18 and 19 of the planks 12 of one mat section 10 will fit into the exposed areas, or female recesses 20 and 21 of an adjacent mat when interconnecting end-to-end in covering a large area.

Similarly, intermediate layer 13 has one of the transverse planks 14 at each end and a pair of adjacent center planks 14 offset laterally to extend beyond the top and underlying layers 11 and 15 the distance of the width of one longitudinal plank 16 on one edge to provide male extensions 22 and 23 at the ends and male extensions 24 and 25 in the middle and to leave exposed areas or female recesses 26, 27 and 28 at the other edge. The width of the female recess 28 is approximately twice the width of the female recesses 26 and 27. The male ends 22, 23, 24, and 25 of the mat 10 will fit into the female recesses 26, 27, and 28, on the next adjacent mat. A longitudinal tie-in plank 29 is provided with each assembly for securely interlocking like sections together as described hereinafter.

A pair of longitudinally and laterally spaced apart looped cables 30 and 31 are provided at the approximate center of gravity of the mat 10 for lifting and transporting the section by a forklift or other suitable handling means. This construction is shown in more detail in FIGS. 3 and 4, and described below.

FIG. 2 shows an another embodiment of interlocking mat section 32 having its length approximately the same as its width to form a generally square configuration. This embodiment may also be interconnected with like sections edge to edge, end to edge, or end to end. The assembled interlocking mat section 32 is of three-ply laminated construction consisting of a top layer 33, comprising substantially parallel and closely spaced longitudinal top wooden planks 34; intermediate layer 35, comprising substantially parallel and closely spaced transverse planks 36; and bottom layer 37, comprising substantially parallel and closely spaced longitudinal planks 38.

Two of the top planks 34 of the surface layer 33 are offset longitudinally with male ends 39 and 40 extending beyond the intermediate layer 35 the distance of the width of one of the transverse planks 36 at one end and leaving exposed areas or female recesses 41 and 42 of the same dimension at the other end. The extended male ends 39 and 40 of the planks 34 of one mat 32 will fit into the exposed areas or female recesses 41 and 42 of an adjacent similar mat section when interconnected to form a large mat-covered area.

The intermediate layer 35 has two of the transverse planks 36 at each end laterally offset with male ends 43 and 44 extending beyond the surface and underlying layers 33 and 37 the distance of the width of one of the longitudinal planks 34 at one end and leaving exposed areas or female recesses 45 and 46 of the same dimension at the other end. The extended male ends 43 and 44 of the planks 36 of the mat 32 will fit into the exposed areas or female recesses 45 and 46, on the next adjacent mat. A longitudinal tie-in plank 47 is provided with each assembly for securely interlocking like sections together.

When the mats are fitted end to edge, the male projecting plank ends 39 and 40 in the top layer overlap the uncovered ends 14 (or 36) on the edge of the next adjacent mat. Of course, it is necessary to cut pieces of planking to fit the space between the ends 39 and 40 and the next adjacent ends so that the top layer is complete.

A pair of longitudinally and laterally spaced cable loops 48 and 49 are provided at approximately the center of gravity of mat 32 for lifting and transporting the section by a forklift or other suitable handling means.

Figure 4:
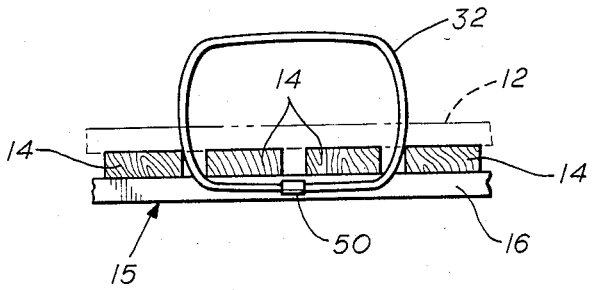
FIG. 4 is a horizontal cross sectional view taken along line 4—4 of FIG. 3 showing details of the cable loop for lifting.
Figure 3:
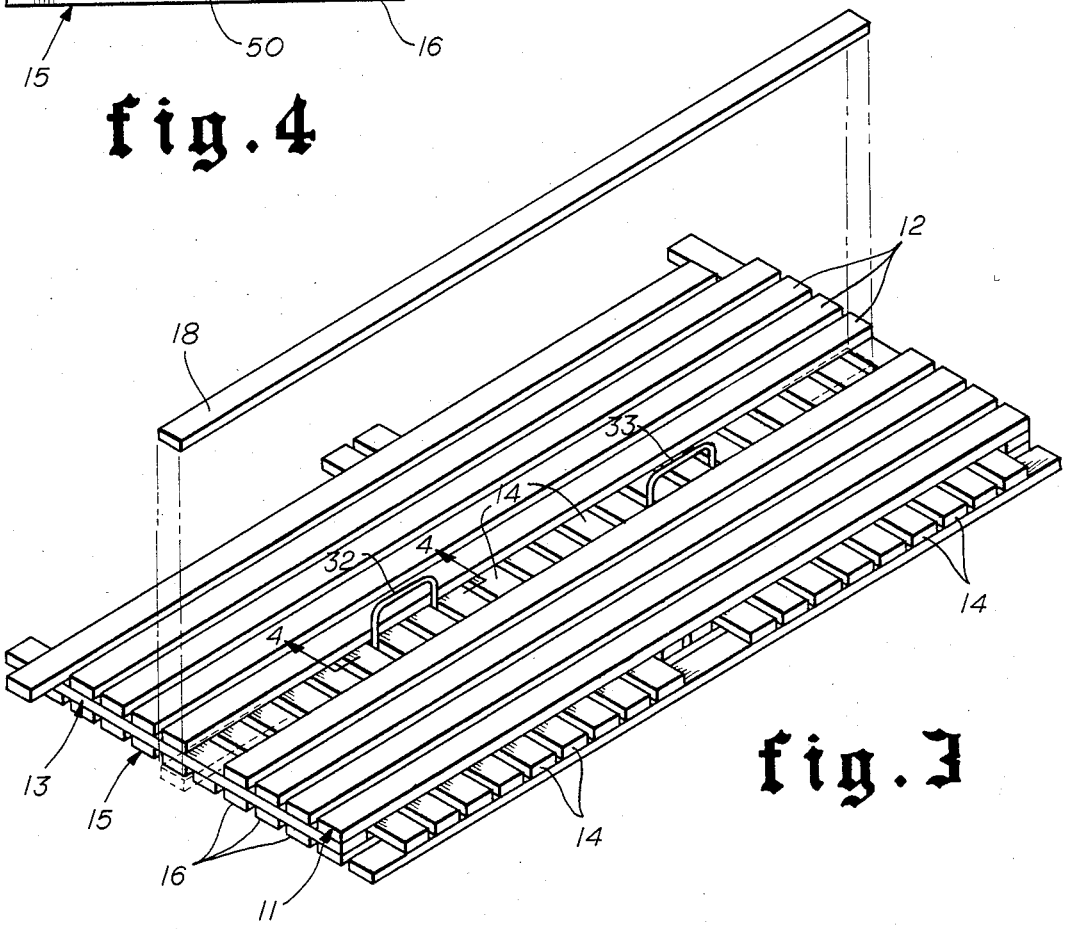
FIG. 3 is an isometric view of the embodiment of FIG. 1 having two loops of cable for lifting.

In FIGS. 3 and 4, details are shown of the manner of installation of the cables 30 and 31. The cables 30 and 31 are looped around the appropriate transverse planks 14, and their ends securely joined by suitable means such as a cable connector 50 (FIG. 4). The plank 12 is then installed in position separating the cables with the male end 18 protruding as previously described. For ease of handling of the cables, the top plank 12 which separates the cables may be supplied loose and then nailed in place after the sections are placed in the desired position overlapping the end of the next adjacent mat section.

Figure 5:
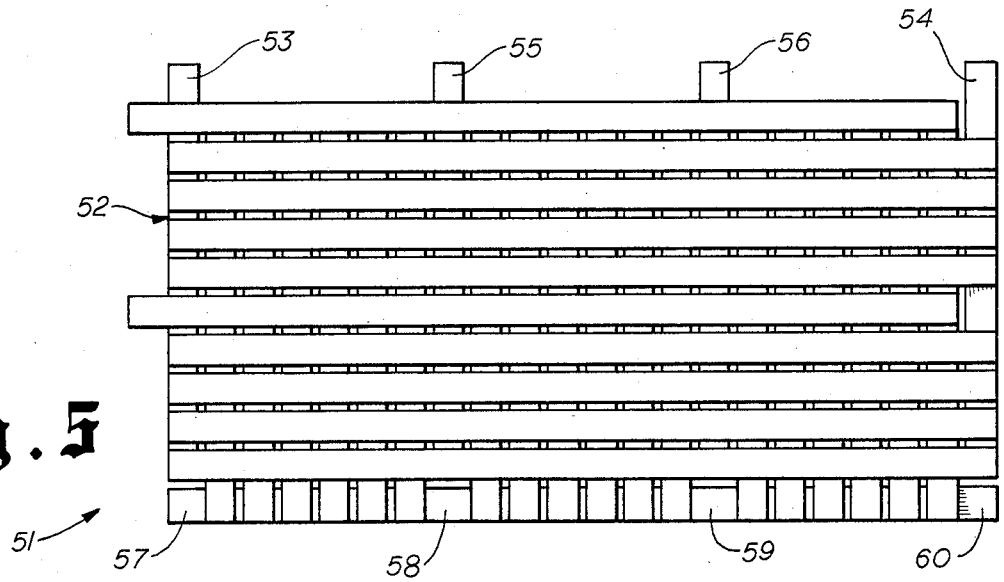
FIG. 5 is a top plan view of another embodiment of the wooden mat having a modified interlocking arrangement.

In FIG. 5, there is shown a modified interlocking mat 51 wherein the intermediate layer 52 has extended transverse planks with male ends 53 and 54 at each end and two offset central planks with male ends 55 and 56 equally spaced from each end, thus providing four exposed areas or female recesses 57, 58, 59, and 60. The extended ends of the planks 53, 54, 55, and 56 of the mat 51 are equally spaced and will fit into the equally spaced exposed areas or female receses 57, 58, 59, and 60, on the next adjacent mat. This embodiment permits assembly of the mat sections in offset as well as aligned relation.

Figure 7:
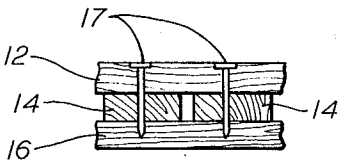
FIG. 7 is a sectional view on the line 7—7 of FIG. 6 showing one nailing detail.
Figure 8:
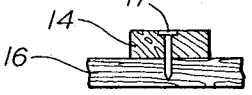
FIG. 8 is a sectional view on the line 8—8 of FIG. 6 showing another nailing detail.
Figure 6:
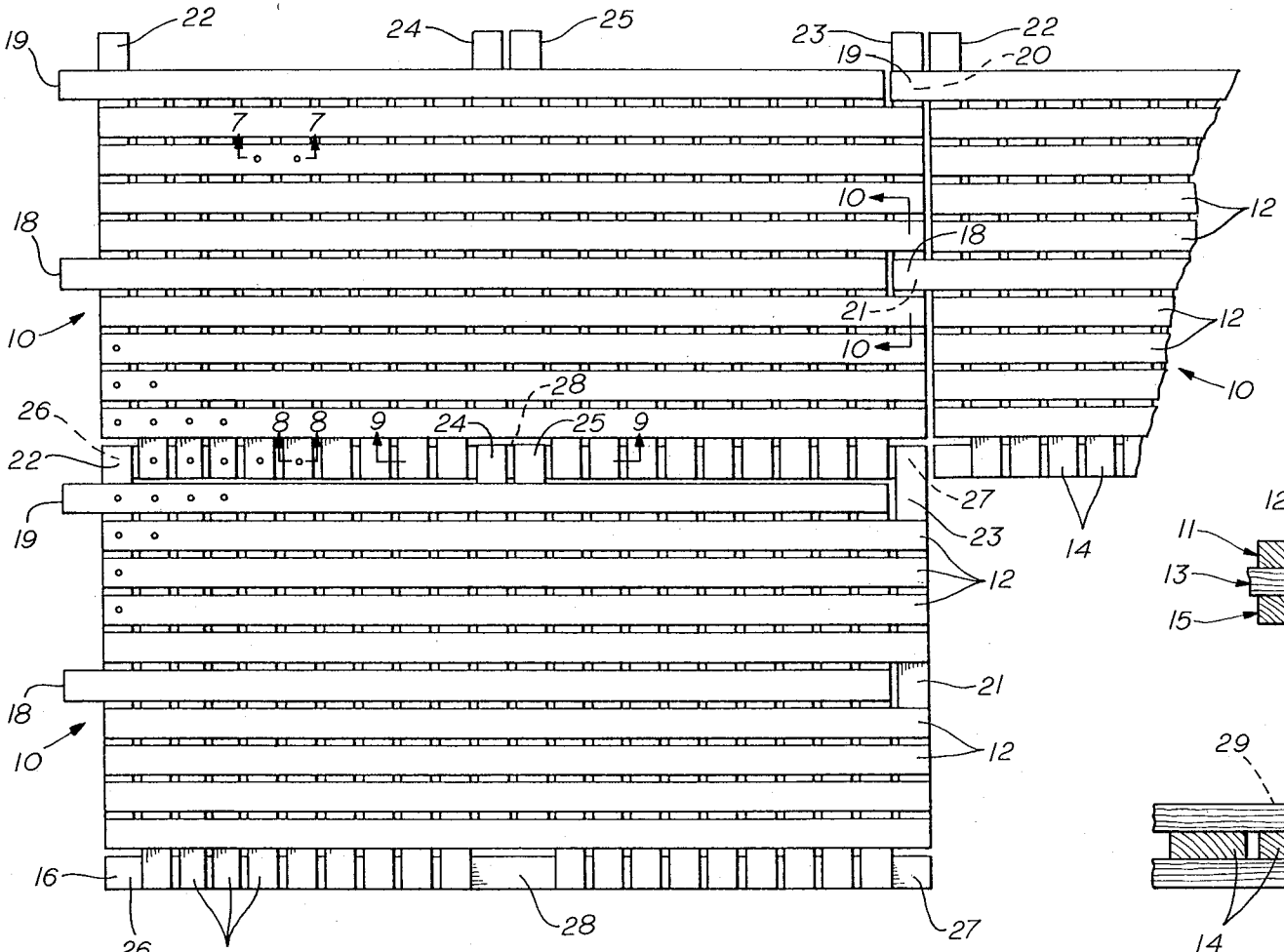
FIG. 6 is a top plan view of the interlocking mats interconnected longitudinally and laterally with other like sections.

Nailing details of the assembled mat sections are shown in FIGS. 6, 7, and 8. At least one nail 17 is driven through each intersection at which the top planks 12, transverse planks 14, and the underlying planks 16 cross (FIG. 7). At least one nail 17 is also driven through the intersection at which the transverse planks 14 and the bottom planks 16 cross and are left exposed until the loose plank 29 or 47 is installed after assembly of adjacent mat sections.

Figure 10:
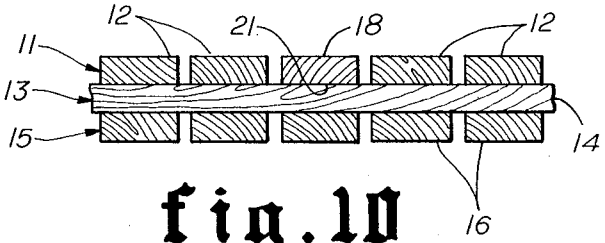
FIG. 10 is a sectional view on the line 10—10 of FIG. 6 showing another interlocking detail.
Figure 9:
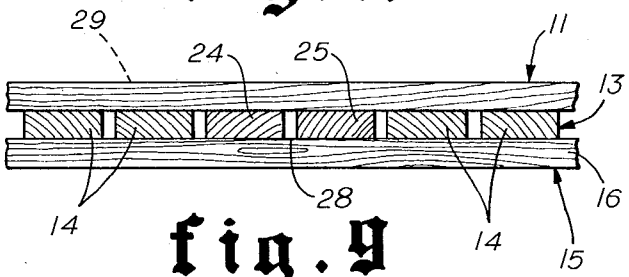
FIG. 9 is a sectional view on the line 9—9 of FIG. 6 showing the interlocking details.

FIGS. 6, 9, and 10 show three like mat sections 10 of the embodiment of FIG. 1 assembled in edge to edge, and end to end relationship. The mat sections can be assembled in end to edge relationship as described for FIG. 2, above, but filler pieces have to be cut and nailed in place. The extended male ends 18 and 19 of the top planks 12 of one mat are fitted into the exposed areas or female ecesses 20 and 21 of an adacent mat for an end to end fit and are nailed together by nails 17 extending through planks 12 and 14 and into plank 16.

The extended male ends 22, 23, 24 and 25 of the transverse planks 14 of the intermediate layer 13 fit into the exposed areas or female recesses 26, 27, and 28, on the next adjacent mat for an edge to edge fit and may be nailed together. After the mats are thus assembled, the exposed male ends 22–25 of the planks 14 of the intermediate layer 13 are covered by the tie-in plank 29 and it is secured by nails 17 extending throgh planks 29 (or 47) and 14 an into plank 16. It is preferred to nail the sections together in the edge to edge fit only by nailing through the loose plank 29 (or 47) since the assemble can be taken apart by removing the plank 29 (or 47) without having to remove nails separately from male extensions 22–25.

The mat assemblies can be separated easily by removing the tie-in plank 29 joining the mat sections edge to edge and removing the nails 17 from the extended male ends 18 and 19 of the top planks 12. The separated mat sections may then be lifted and transported to another location where they may be reused. The tie-in board 29 could, if desire, overlap to extend from the central plank 25 of one mat to the central plank 24 of another mat. Likewise, the tie-in board 29 could be supplied in various lengths to accomodate various tie-in configurations of mat assemblies.

While this invention has been described fully and completely with special emphasis upon a preferred embodiment, it should be understood that within the scope of the appended claims the invention may be practiced otherwise than as specifically described herein.

I claim:

1. A laminated wooden mat section of at least three ply construction adapted to be secured in interlocking relation to other like mat sections for supporting heavy equipment and vehicles around or leading to oil field drilling sites or the like, said mat section comprising;

a lower layer of substantially parallel and closely spaced longitudinally extending wooden planks of substantially equal length with the ends thereof aligned to define a square or rectangular configuration, an intermediate layer of substantially parallel and closely spaced planks overlying said lower layer and extending transversely thereto, said intermediate layer planks being of substantially equal length and extending transversely from one edge to the other of said lower layer with substantially all of the ends aligned in said square or rectangular configuration, an upper layer of substantially parallel and closely spaced longitudinally extending wooden planks overlying said intermediate layer in parallel relation to said lower layer, said upper layer planks being of substantially equal length with substantially all of the ends aligned with the ends of said lower layer in said square or rectangular configuration, at least one plank of said upper layer being longitudinally offset to provide a male extension at only one end and a female recess only at the other end of said upper layer, at least one plank of said intermediate layer being laterally offset to provide a male extension at only one edge and a female recess only at the other edge of said intermediate layer, said upper layer having one less plank than said lower layer at one edge of thereof to expose the ends of said transversely extending planks of said intermediate layer and to expose said female recesses along one edge of said mat section to permit an adjacent mat male extension to be lowered thereinto during assembly, said layers being securely attached together at common overlapping intersections, and said upper layer male extensions being adapted to fit and be removably secured in said upper layer female recesses on an adjacent mat and said intermediate layer male extensions being adapted to fit and be removably secured in said intermediate layer female recesses on an adjacent may by being lowered into position for assembly in an edge to edge, and end to end configuration with the edges and ends, respectively, of adjacent mats being in a straight line.

2. A mat section according to claim 1 including a longitudinally extending tie-in plank adapted to be removably secured in a position parallel to said planks of said upper layer to cover said intermediate layer exposed ends on said transversely extending planks for interlocking adjacent mat assemblies releasably together in edgewise relation.

3. A mat section according to claim 1 in which said upper layer has one end plank and one centrally disposed plank longitudinally offset to provide male extensions beyond said intermediate layer a distance of approximately the width of one of said transversely extending planks at one end and to provide female recesses of like size at the other end.

4. A mat section according to claim 1 in which said intermediate layer has one plank at each end laterally offset to provide male extensions beyond said upper layer and said lower layer a distance substantially the width of one of said said longitudinally extending planks at one edge and to provide female recesses of like size at the other edge.

5. A mat section according to claim 1 in which said intermediate layer has a pair of planks intermediate each end laterally offset to provide male extensions beyond said upper layer and said lower layer a distance substantially the width of one of said longitudinally extending planks at one edge and to provide female recesses of like size at the other edge.

6. A mat section according to claim 1 in which said intermediate layer has a pair of adjacent planks intermediate each end laterally offset to provide male extensions beyond said upper layer and said lower layer a distance substantially the width of one of said longitudinally extending planks at one edge and to provide female recesses of like size at the other edge.

7. A mat section according to claim 1 in which said upper layer has one end plank and one centrally disposed plank longitudinally offset to provide male extensions beyond said intermediate layer a distance of approximately the width of one of said transversely extending planks at one end and to provide female recesses of like size at the other end, and said intermediate layer has one plank at each end and a pair of planks intermediate each end laterally offset to provide male extensions beyond said upper layer and said lower layer a distance substantially the width of one of said longitudinally extending planks at one edge and to provide female recesses of like size at the other edge.

8. A mat section according to claim 1 in which said upper layer has one end plank and one centrally disposed plank longitudinally offset to provide male extensions beyond said intermediate layer a distance of approximately the width of one of said transversely extending planks at one end and to provide female recesses of like size at the other end, and said intermediate layer has one plank at each end and a pair of adjacent planks centrally located and laterally offset to provide said male extensions at one edge and to provide female recesses of like size at the other edge.

9. A mat section according to claim 1 in which the planks of said layers are composed of road grade lumber.

10. A mat section according to claim 1 in which said planks are securely attached together at common overlapping intersections by nails.

11. A plurality of mat sections according to claim 1 assembled in end to end and in edge to edge relation with the male extensions on one fitting the corresponding female recesses on an adjacent one and nailed to the underlying layer thereof and having longitudinally extending tie-in planks nailed in a position parallel to said planks of said upper layer and above said exposed ends on said transversely extending planks and through said intermediate layer male extensions to interlock adjacent mat assemblies releasably together in edgewise relation.

12. A mat section according to claim 1 in which the length of said mat section is substantially twice the width to provide a generally rectangular configuration.

13. A plurality of mat sections according to claim 12 assembled in end to end and in edge to edge relation with the male extensions on one fitting the corresponding female recesses on an adjacent one and nailed to the underlying layer thereof and having longitudinally extending tie-in planks nailed in a position parallel to said planks of said upper layer and above said exposed ends on said transversely extending planks and through said intermediate layer male extensions to interlock adjacent mat assemblies releasably together in edgewise relation.

14. A mat section according to claim 1 in which the length of said mat section is substantially the same as the width to form a generally square configuration.

15. A plurality of mat sections according to claim 14 assembled in end to end and in edge to edge relation with the male extensions on one fitting the corresponding female recesses on an adjacent one and nailed to the underlying layer thereof and having longitudinally extending tie-in planks nailed in a position paralled to said planks of said upper layer and above said exposed ends on said transversely extending planks and through said intermediate layer male extensions to interlock adjacent mat assemblies releasably together in edgewise relation.

16. A mat section according to claim 1 in which said upper layer has one end plank and one centrally disposed plank longitudinally offset to provide male extensions beyond said intermediate layer a distance of approximately the width of one of said transversely extending planks at one end and to provide female recesses of like size at the other end, and said intermediate layer has one plank at each end laterally offset to provide male extensions beyond said upper layer and said lower layer a distance substantially the width of one of said said longitudinally extending planks at one edge and to provide female recesses of like size at the other edge.

17. A plurality of mat sections according to claim 16 assembled in end to end and in edge to edge relation with the male extensions on one fitting the corresponding female recesses on an adjacent one and nailed to the underlying layer thereof and having longitudinally extending tie-in planks nailed in a position parallel to said planks of said upper layer and above said exposed ends on said transversely extending planks and through said intermediate layer male extensions to interlock adjacent mat assemblies releasably together in edgewise relation.

18. A mat section according to claim 1 including means secured thereon for lifting and transporting the same.

19. A mat section according to claim 18 in which said lifting and transporting means is secured on at least one plank below said upper layer, and at least one plank in said upper layer adjacent said lifting and transporting means is removable for providing access thereto.

20. A mat section according to claim 18 in which said lifting and transporting means comprises a pair of longitudinallly and laterally spaced cable loops secured at points substantiallly equidistant from and on opposite sides of the center of gravity of said mat section around selected planks of said intermediate layer.

21. A plurality of mat sections according to claim 20 assembled in end to end and in edge to edge relation with the male extensions on one fitting the corresponding female recesses on an adjacent one and nailed to the underlying layer thereof and having longitudinally extending tie-in planks nailed in a position parallel to said planks of said upper layer and above said exposed ends on said transversely extending planks and through said intermediate layer male extensions to interlock adjacent mat assemblies releasably together in edgewise relation.

22. A mat section according to claim 1 in which said upper layer has one end plank and one centrally disposed plank longitudinally offset to provide male extensions beyond said intermediate layer a distance of approximately the width of one of said transversely extending planks at one end and to provide female recesses of like size at the other end, and said intermediate layer has a pair of planks intermediate each end laterally offset to provide male extensions beyond said upper layer and said lower layer a distance substantially the width of one of said longitudinally extending planks at one edge and to provide female recesses of like size at the other edge.

23. A mat section according to claim 22 in which said offset intermediate planks have the same lateral spacing as said offset upper layer planks.

24. A plurality of mat sections according to claim 22 assembled in end to end and in edge to edge relation with the male extensions on one fitting the corresponding female recesses on an adjacent one and nailed to the underlying layer thereof and having longitudinally extending tie-in planks nailed in a position parallel to said planks of said upper layer and above said exposed ends on said transversely extending planks and through said intermediate layer male extensions to interlock adjacent mat assemblies releasably together in edgewise relation.

* * * * *